US008210016B2

(12) United States Patent
Szuba et al.

(10) Patent No.: US 8,210,016 B2
(45) Date of Patent: Jul. 3, 2012

(54) MULTI-STATION DIES FOR EXTRUDING TEETH

(75) Inventors: Joseph Szuba, Dearborn, MI (US); Rodney G. Whitbeck, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 943 days.

(21) Appl. No.: 12/245,080

(22) Filed: Oct. 3, 2008

(65) Prior Publication Data

US 2010/0083723 A1 Apr. 8, 2010

(51) Int. Cl.
*B21C 23/04* (2006.01)
*B21J 11/00* (2006.01)

(52) U.S. Cl. ..... 72/264; 72/405.01

(58) Field of Classification Search ..... 72/264, 72/257, 405.01, 405.07, 419, 421, 426; 100/207; 414/226.04; 198/468.9, 580
See application file for complete search history.

(56) References Cited

U.S. PATENT DOCUMENTS

| | | | | |
|---|---|---|---|---|
| 4,692,071 | A | 9/1987 | Hirota | |
| 4,770,572 | A | 9/1988 | Ohkawa et al. | |
| 4,772,368 | A | 9/1988 | Rabian | |
| 5,465,597 | A | 11/1995 | Bajraszewski et al. | |
| 5,538,369 | A | 7/1996 | Okuda | |
| 5,551,270 | A | 9/1996 | Bajraszewski et al. | |
| 5,582,061 | A * | 12/1996 | Harsch et al. | 72/405.1 |
| 6,204,466 | B1 | 3/2001 | Tabor | |
| 6,343,497 | B2 * | 2/2002 | Hasegawa | 72/102 |

* cited by examiner

*Primary Examiner* — Teresa M Ekiert
(74) *Attorney, Agent, or Firm* — Raymond Coppiellie; MacMillan, Sobanski & Todd, LLC

(57) ABSTRACT

A system for extruding teeth in a workpiece includes a first mandrel supported on a first press and including first die teeth that produce partially formed teeth on the workpiece as the first die teeth are extruded into the workpiece by the first press, a second mandrel supported on a second press and including second die teeth that produce fully formed teeth on the workpiece as the second die teeth are extruded into the workpiece by the second die station, and a transfer system for supporting and carrying the workpiece with the lower die assembly from the first press to the second press.

18 Claims, 4 Drawing Sheets

MULTI-STATION DIES FOR EXTRUDING TEETH

BACKGROUND OF THE INVENTION

1. Field of the Invention

This invention relates generally to extruding teeth, such as gear teeth or spline teeth, and more particularly to use of multi-station tooling for extruding helical teeth in a workpiece, such as a gear blank.

2. Description of the Prior Art

Planetary gear units of the type used in automotive transmissions include ring gears having internal helical teeth rather than straight gears even though helical gear teeth are more difficult to form. The internal gear teeth must be formed with very precise dimensions and spacing in order to perform correctly.

Machining helical gears requires expensive tooling and equipment. Current processes for forming helical teeth include broaching, shaper cutting, grinding and hobbing, all being slow processes and requiring expensive capital equipment.

Back extrusion of internal splines or helical gears is much faster, but sometimes cannot produce in one operation a complex involute tooth profile to the required dimensional accuracy. Conventional back extrusion techniques produce tooth profiles that are accurate over most of the tooth shape, but are not within specification in certain regions due to difficult geometry or failure to fill certain volumes with metal during the forming process.

A source of noise produced by transmission gearing is produced by tooth-to-tooth interactions among gears during service operation. Noise sources have been shown to result from out-of-round condition of ring gears and from surface characteristics of the mating gear teeth.

Gears having similar surface finishes can produce vibration that results in audible noise. To reduce noise, gear makers strive to achieve tooth surfaces that are very smooth and precise. Cost of gear tooth finishing has increased as efforts to reduce audible gear noise have accelerated. Gear finishing processes, such as hobbing, broaching and grinding, all produce gears with tooth surfaces that are characteristic of the process and are very similar tooth-to-tooth.

A need exists in the metal forming industry for a method that forms gear teeth at high productivity rates having a completely formed tooth profile that meets a precise accuracy standard for dimensions and tolerances and produces a random and irregular surface finish on each tooth that is dissimilar to the surface finish of the mating teeth.

SUMMARY OF THE INVENTION

A system for extruding teeth in a workpiece includes a first mandrel supported on a first die including first die teeth that produce partially formed teeth on the workpiece as the first die teeth are extruded into the workpiece by the first die, a second mandrel supported on a second die and including second die teeth that produce fully formed teeth on the workpiece as the second die teeth are extruded into the workpiece by the second die, and a transfer system for supporting and carrying the workpiece from a first station to a second station.

A method for extruding teeth in a workpiece includes providing a first die and a second die, each having a set of die teeth, producing partially formed teeth on the workpiece by extruding first die teeth into the workpiece using the first press, and producing fully formed teeth on the workpiece by extruding second die teeth into the workpiece using the second press.

Certain automotive transmission gears, such as helical ring gears, are difficult to form by extrusion methods due to the involute tooth profile. The multi-step extrusion method makes full tooth shape generation possible and enables forming complex involute geometries at high productivity rates, which, otherwise, would be difficult or impossible with conventional gear machining technology.

Extruded surface finishes can be made to vary from tooth-to-tooth or in regions around the finished product. This provides designers an opportunity to incorporate specific surface characteristics to minimize gear tooth noise and provides surface features that can be filled with lubricant to reduce friction or to produce asymmetric tooth profiles to improve performance.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
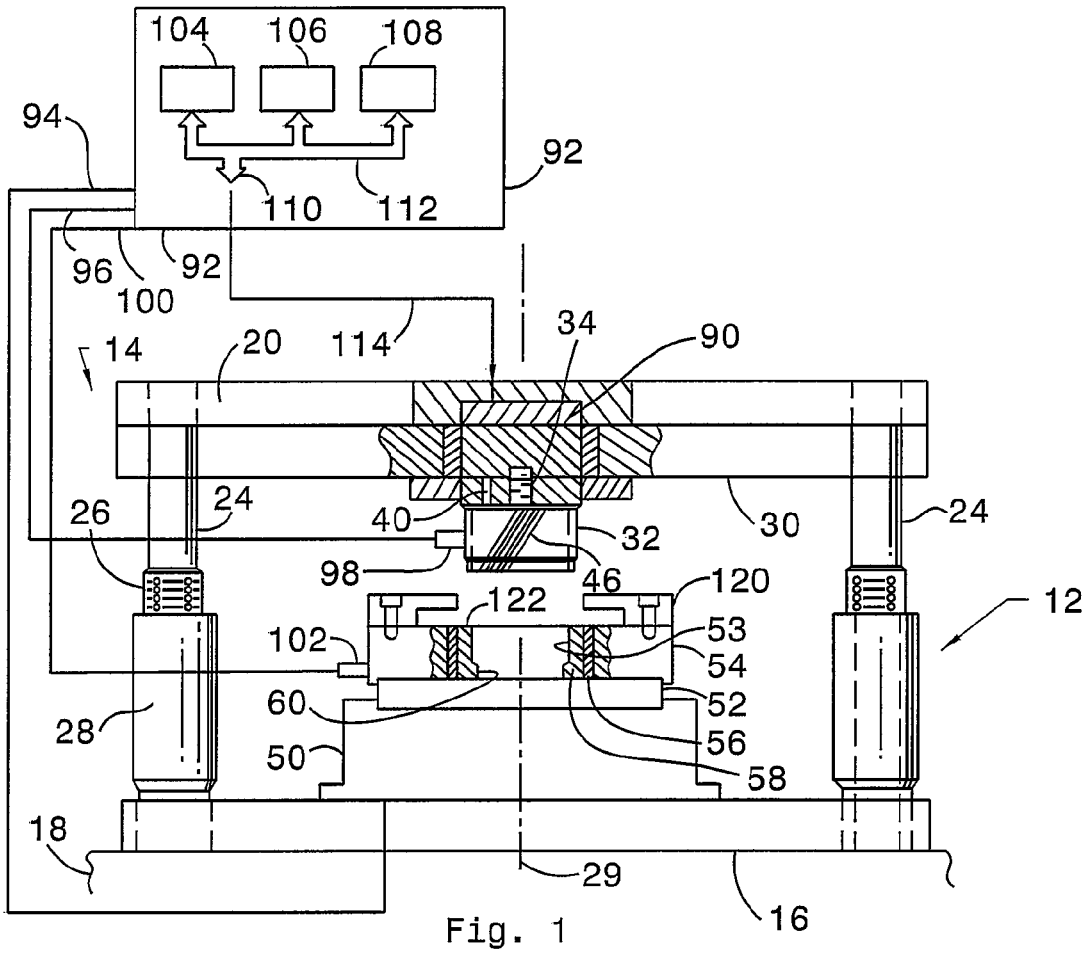
FIG. 1 is a front view of an extrusion press equipped with a servo motor for forming internal helical gear teeth on a gear blank.
Figure 2:
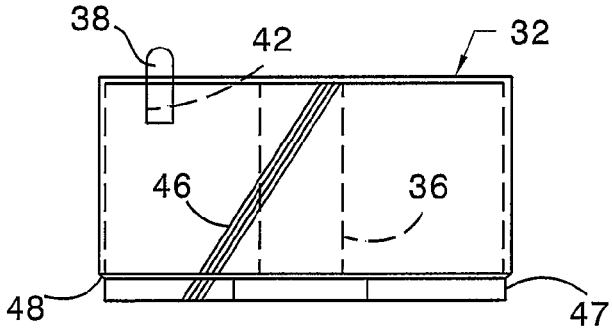
FIG. 2 is front view of a mandrel used in the extrusion press of FIG. 1.

Referring to FIGS. 1 and 2, an extrusion assembly 12, mounted in a conventional hydraulic press 14, includes a lower die plate 16, resting on a base portion 18 of the press 14, and an upper die plate 20. Die guide posts 24 extend between upper die plate 20 and lower die plate 16. One end of each die guide post 24 is fixed to upper die plate 20; the opposite end of each die guide post 24 has a ball bearing cage 26 attached to it. Affixed to lower die plate 16 are guide bushings 28, with each guide bushing 28 aligned with one ball bearing cage 26. Ball bearing cages 26 telescopically slide into their respective guide bushings 28 to allow axial movement of upper die plate 20 relative to lower die plate 16, minimizing friction and maintaining the two die plates 16, 20 mutually parallel. The assembly 12 is concentric with and translates along an axis 29.

A support plate 30, guided on the guide posts 24, is secured to the upper die plate 20 for vertical movement with plate 20 along axis 29. A mandrel 32 is fastened to support plate 30 by a bolt 34, which slips through a bore 36 in the center of mandrel 32 and engages a tapped screw thread in support plate 30. Dowels 38 mate both with dowel holes 40 in support plate 30 and corresponding dowel holes 42 in mandrel 32. Mandrel 32 is formed with external die teeth 46, a lead surface 47, and a single step 48, which is preferred to a multiple-step mandrel. If the workpiece 58, which is to be formed with internal or external helical gear teeth, has features which are difficult to form in a single step, then a multi-step mandrel may be needed since it has multiple sets of teeth with increasing precision to distribute the workpiece material more accurately to the desired shape. This also contributes to longer die tooth life. The helix angle of die teeth 46 is the same as that desired in the gear to be formed from the workpiece.

A load cell 50, mounted on lower die plate 16, includes force sensors mounted within it and electrically connected to a controller. Load cell 50 senses the magnitude of load and torque applied to it during the forming process. If the load is out of predetermined ranges of these parameters, then the press will stop the forming operation so that the press equipment can be checked. Load cell 50 is optional, and the extrusion process can be conducted without this piece of equipment, if so desired.

Mounted on load cell 50 is a die base 52. A retainer ring 54, mounted on die base 52, has a cylindrical central cavity. A hardened sleeve insert 56, fitted within the retainer ring 54, surrounds the workpiece gear blank 58. The die base 52 supports the gear blank 58 axially during the forming process. Retainer ring 54, sleeve insert 56 and gear blank 58 are located concentric with axis 29 and mandrel 32. The gear blank is formed with a cylindrical central cavity 53 that is aligned with axis 29

A typical gear blank 58 includes an annular shell of precise internal diameter, in which the internal helical gear teeth will be extruded during the forming process, and a lip 60 protruding from the inner diameter at the blind end of the gear blank 58. FIG. 1 shows the gear blank 58 inserted into the sleeve insert 56.

A servo motor 90, secured to upper die plate 20, faces toward mandrel 32, and has its shaft driveably connected to the mandrel, such that the servo motor and the mandrel rotate about axis 29 as a unit in response to control signals produced by a controller 92.

Electronic signals 94, produced by load cell 50 and representing the magnitude of the extrusion force and torque and the speed of press 14 are supplied to controller 92 as input. Electronic signals 96 produced by sensors 98 representing the angular displacement of mandrel 32 and the rotor of servo motor 90 from a reference position about axis 29, and the speed of motor 90 are supplied to controller 92 as input. Electronic signals 100 produced by sensor 102 representing the angular displacement of workpiece 58 from a reference position about axis 29 are also supplied to controller 92 as input.

Controller 92 preferably includes an electronic microprocessor 104, electronic memory 106, and signal conditioning circuits 108, which communicate mutually and with an output 110 over a data bus 112. The memory contains a control algorithm, which is executed using variables represented by the input signals and is programmed to produce many different helical gear lead angles and continually adjusts to deviation from expected behavior of the press 14.

Control signals 114 are carried from the output 110 of controller 92 to a servo motor control (not shown), which actuates servo motor 90 to rotate about axis 29 in response to the control signal produced by controller 29. Similarly, controller 92 causes the assembly 12 to translate vertically along axis 29.

The extrusion assembly 12 is used in a cold extrusion process for forming internal helical teeth in gear blanks 58, with tight control of lead accuracy.

In operation, a gear blank 58 is inserted into ring insert 56 with its open end facing mandrel 32. Hydraulic press 14 is activated and forces the upper die plate 20 downward toward lower die plate 16, guided by die guide posts 24.

This axial translation carries mandrel 32 toward gear blank 58 such that the lead surface 47 enters the central opening 53 in the workpiece 58. Servo motor 90 causes mandrel 32 to rotate about axis 29 to a desired angular position, at which the helical die teeth 46 on the external surface of mandrel 32 first contact the gear blank workpiece 58. When the mandrel 32 is in its desired angular position, hydraulic press 14 is actuated to continue its axial translation and servo motor 90 is actuated to rotate at a speed that is related to the speed of its axial translation such that the internal gear teeth are formed on the workpiece 58 with the desired helix angle.

Die teeth 46 on mandrel 32 engage the inner surface of gear blank 58 and move downward into the material of the workpiece with a helical motion supplied by the programmed servo motor as they are forced into the gear blank, thereby forming helical gear teeth. When the predetermined depth of finished gear teeth is reached, hydraulic press 14 stops pressing on upper die plate 20 and retracts the upper die plate 20 and mandrel 32. The servo motor reverses the helix motion of the mandrel and exerts forming forces on the opposite side of the gear flank which wasn't fully formed with the downward motion of the press ram.

This movement causes mandrel 32 to withdrawal upward and to lift the workpiece 58 from the surface of to die base 52. A box stripper 120, secured to the die base 52, contacts the upper surface 122 of the workpiece 58 forcing it from the mandrel 32 and allowing the mandrel to withdraw from the extruded gear. The motion of withdrawal will precisely follow that of insertion, thereby reducing the risk of nicking or deforming any of the gear teeth during removal of mandrel 32 from the finished ring gear.

The finished ring gear is then removed from press 14 and another gear blank 58 is inserted in its place preparatory to repeating the forming process. Because the travel distance of the press 14 is short, the length of the cycle period is short time and throughput is increased substantially over conventional techniques.

Figure 3:
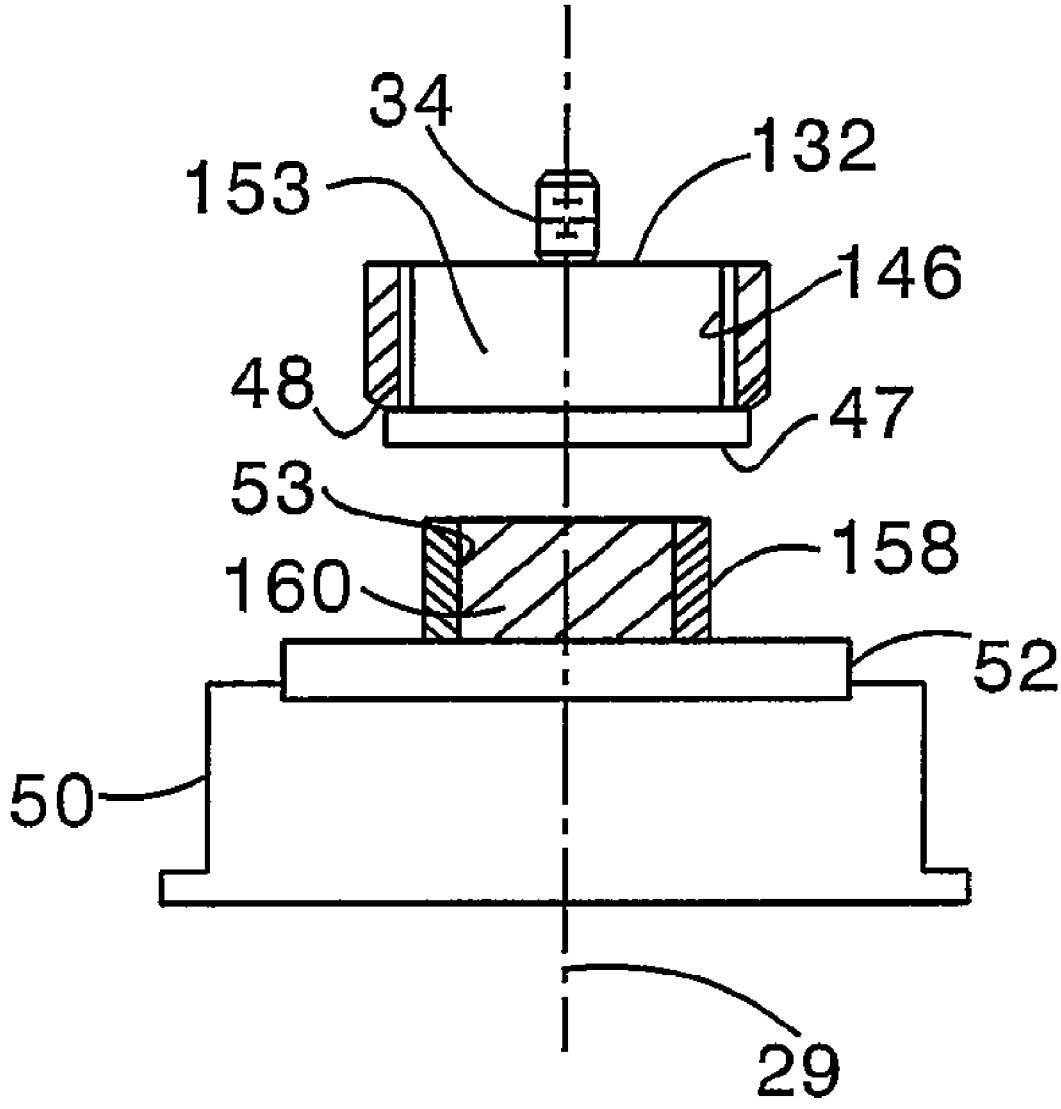
FIG. 3 is front view of a mandrel and die base used to extrude external helical gear teeth in a gear blank.

Although the extrusion process has been described with reference to external helical die teeth 46 on the workpiece 58 being used to extrude internal teeth on the workpiece 58, as FIG. 3 illustrates, if external helical gear teeth are to be extruded on a workpiece 158, a mandrel 132 is formed with a central cylindrical cavity 153, which surrounds the outer surface of the workpiece 158 and is aligned with axis 29. The inner surface of workpiece 158 is supported by a cylindrical plug 160 located in the central, cylindrical cavity 53 of the workpiece. The inner surface of mandrel 132 is formed with helical die teeth 146. The servo motor 90 is driveably connected to mandrel 132 and rotates the mandrel to the required helix gear tooth angle as the press 14 forces the die teeth 146 axially into and through the wall of the workpiece 158, thus forming external helical gear teeth on the outer surface of the workpiece or gear blank 158.

Figure 4:
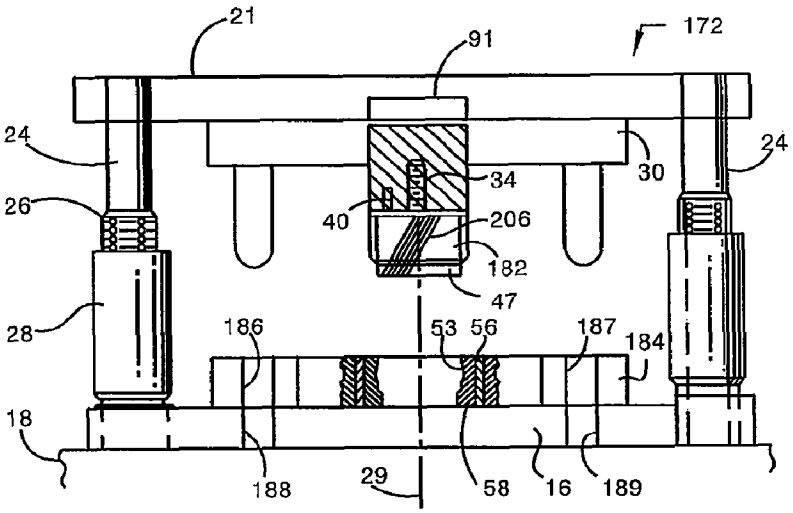
FIG. 4 is a front view of a two extrusion presses for forming helical gear teeth on a gear blank.
Figure 4:
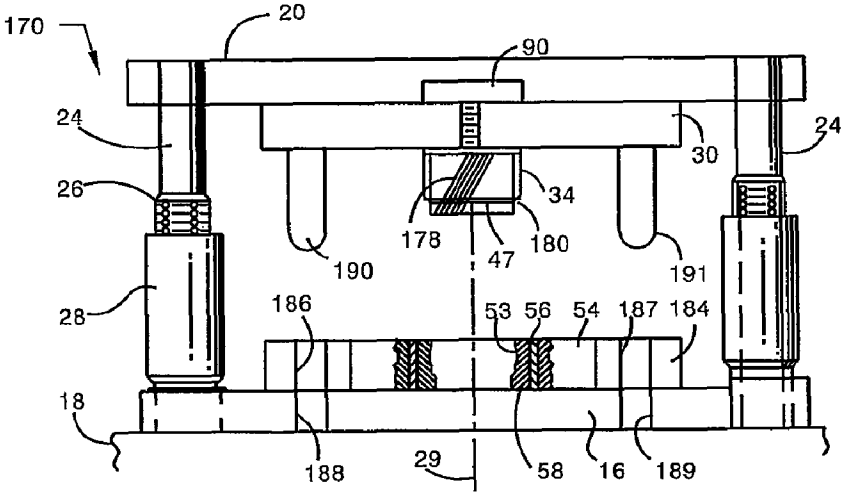
Figure 5:
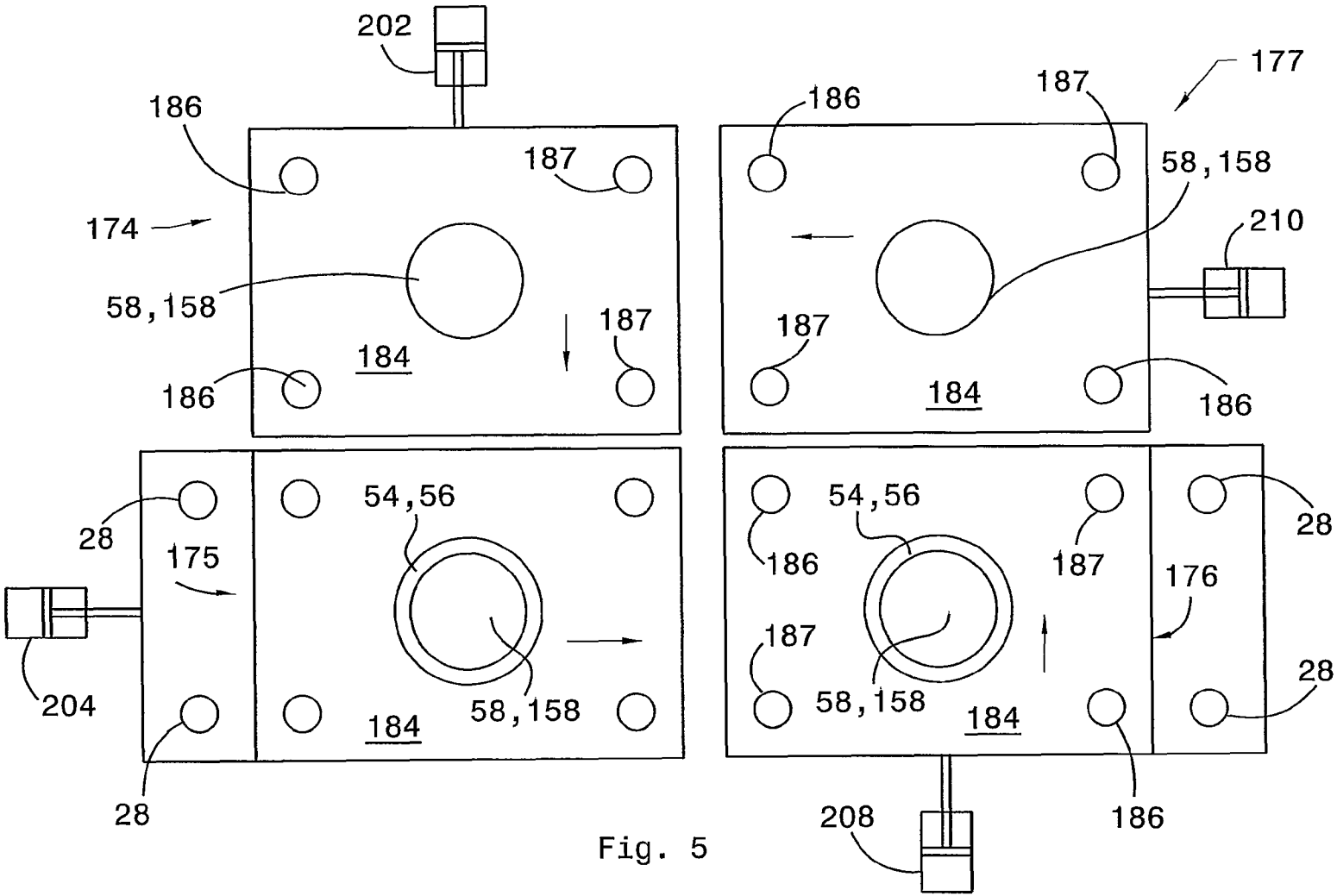
FIG. 5 is a plan view of four stations in a path traveled by a shuttle that transports a gear blank to and from the extrusion presses of FIG. 4.

To obtain extruded gears, which consistently meet dimensional requirements, a multi-step forming process is used. FIGS. 4 and 5 illustrate a multi-station extrusion operation that includes a first hydraulic press 170, where semi-finished helical teeth are formed in a gear blank 58, 158, and a second hydraulic press 172, where the teeth are finish-formed and an irregular surface finish is produced on the flanks of the teeth.

The presses 170, 172 are substantially identical to the hydraulic press shown in FIG. 1 including the servo motor 90.

The first press 170 partially forms teeth on the blank 58, 158 in a first step. A transfer line then moves the lower die to the second station, which finish-forms the surfaces being extruded during a second step following the first step.

FIG. 5 illustrates movement of the gear blank 58, 158 among shuttle stations 174, 175, 176, 177, upon being actuated by a shuttle mechanism, which maintains the position and orientation of the gear blank as required to meet final product requirements.

Positioning of the gear blank 58, 158 is maintained constant relative to axis 29 and forming mandrels 180, 182 by the addition to presses 170, 172 of a moveable shuttle 184, which is formed with bored holes 186, 187, each of which is aligned with a respective hole 188, 189 in the lower die plate 16. Support plate 30 carries pins 190, 191, which depend from its lower surface. When the upper die plate 20 of press 170 is lowered sufficiently, pins 190 enter the aligned bores 186 and 188. When the upper die plate 21 of press 172 is lowered sufficiently, pins 191 enter aligned bores 187 and 189.

In operation, the gear blank 58, 158 is placed on a shuttle 184 at load-shuttle station 174, and a piston-cylinder assembly 202 is actuated to move the shuttle 184 to the second station 175 at press 170. There, retaining ring 54 and hardened sleeve 56 are placed around the gear blank 58, or plug 160 is inserted into the cavity 53 of the blank 158, depending on whether internal or external helical gear teeth are to be extruded. The upper die plate 20 is lowered, die teeth 178 of mandrel 180 are extruded in a semi-finished condition in the surface of the gear blank partially forming the helical gear teeth, and mandrel 180 is raised from the blank.

Then a second piston-cylinder assembly 204 is actuated to move shuttle 184 to the third station 176 at press 172. There, the upper die plate 21 of press 172 is lowered, die teeth 206 of mandrel 182 are extruded in a finish-formed condition into the surface of the gear blank 58, 158 forming the helical gear teeth, and mandrel 182 is raised from the blank.

A third piston-cylinder assembly 208 is actuated to move shuttle 184 to the unload-shuttle station 177 where the gear blank 58, 158 is removed from the shuttle 184. There, a fourth piston-cylinder assembly 210 is actuated to move shuttle 184 to the load-shuttle station 174, where a second gear blank is placed on the shuttle. The same procedure is repeated on the second gear blank at each of the stations 174-177.

The die teeth 178, 182 on forming mandrels 180, 182 are essentially the inverse of the teeth to be extruded in the workpiece. Each die tooth on a mandrel produces a corresponding tooth on the workpiece, and the flanks of at least some of the fully formed extruded teeth are custom surface finished.

Surface striations, such as minute grooves, scratches, or channels, can be applied as needed to the flanks of the extruded teeth to reduce gear noise. To counteract vibration resonance, a varied, irregular surface finish is produced in zones in the flanks of the fully formed extruded teeth. For example, on teeth located in an angular range from 0 to 90 degrees about axis 29, a first surface finish is produced that is different from the surface finish produced on teeth in an angular range from 180 to 270 degrees around axis 29.

To apply specific finishes to individual teeth or to angular zones of the fully formed extruded teeth on the workpiece 58, 158, preferably mandrel 182 is made with surface-producing details in those regions. Mandrel 182 is ground according to a specific grinding protocol, which places on its die teeth in a first angular zone about axis 29 a first surface finish, and places on its die teeth in a second angular zone about axis 29, different from the first zone, a second surface finish, different from the first surface finish. As mandrel 82 is extruded into the workpiece 58, 158, the first and second surface finishes are transferred to the flanks of the extruded teeth in each respective zone. In this way, a first portion of the extruded teeth on the workpiece will conform to the first surface finish, and a second portion of the extruded teeth will conform to the second surface finish.

Alternatively, to obtain the same low gear noise characteristics, a post forming operation, such as acid etching, laser surface treatment, surface alteration using abrasive high pressure water jets, sand blasting or a combination of these, is preferably performed on the flanks of the extruded gear teeth at station 176 or 177.

In accordance with the provisions of the patent statutes, the preferred embodiment has been described. However, it should be noted that the alternate embodiments can be practiced otherwise than as specifically illustrated and described.

The invention claimed is:

1. A system for extruding teeth in a workpiece comprising:

a first mandrel supported on a first press and including first die teeth that produce partially formed gear teeth on the workpiece as the first die teeth are extruded into the workpiece by the first press;

a second mandrel supported on a second press and including second die teeth that produce fully formed gear teeth on the workpiece as the second die teeth are extruded into the workpiece by the second press; and a transfer system for supporting and carrying the workpiece from the first press to the second press.

2. The system of claim 1 wherein the transfer system further comprising:

a first station where the workpiece is placed on a shuttle; and a first actuator that moves the shuttle from the first station to a second station at the first press.

3. The system of claim 2 wherein the transfer system further comprising:

a second actuator that moves the shuttle from the second station at the first press to a third station at the second press.

4. The system of claim 3 wherein the transfer system further comprising:

a third actuator that moves the shuttle from the third station at the second press to a fourth station.

5. The system of claim 4 wherein the transfer system further comprising:

a fourth station where the workpiece is removed from the shuttle; and a fourth actuator that moves the shuttle from the fourth station to the first station.

6. The system of claim 1 wherein the first die teeth of the first mandrel are helical die teeth that produce partially formed helical teeth on the workpiece as the first die teeth of the first mandrel are extruded into the workpiece by the first press.

7. The system of claim 1 wherein the first die teeth of the first mandrel are helical die teeth that produce partially formed internal helical teeth on the workpiece as the first die teeth of the first mandrel are extruded into the workpiece by the first press.

8. The system of claim 1 wherein the second die teeth of the second mandrel are helical die teeth that produce fully formed helical teeth on the workpiece as the second die teeth of the second mandrel are extruded into the workpiece by the second press.

9. The system of claim 1 wherein the second die teeth of the second mandrel are helical die teeth that produce fully formed internal helical teeth on the workpiece as the second die teeth of the second mandrel are extruded into the workpiece by the second press.

10. The system of claim 1 wherein:

the first press further includes a first servo motor driveably coupled to the first mandrel for rotating the first mandrel about the axis as the first die teeth are extruded into the workpiece; and the second press further includes a second servo motor driveably coupled to the second mandrel for rotating the second mandrel about the axis as the second die teeth are extruded into the workpiece.

11. A method for extruding teeth in a workpiece comprising the steps of:

(a) providing a first press and a second press, each having a set of die teeth;

(b) producing partially formed gear teeth on the workpiece by extruding first die teeth into the workpiece using the first press; and (c) producing fully formed gear teeth on the workpiece by extruding second die teeth into the workpiece using the second press.

12. The method of claim 11 further comprising moving the workpiece from the first press to the second press after using the first press.

13. The method of claim 11 further comprising the steps of:

placing the workpiece on a shuttle at a first station;

moving the shuttle from the first station to a second station at the first press;

moving the shuttle from the second station to a third station at the second press;

moving the shuttle from the third station to a fourth station; and removing the workpiece form the shuttle.

14. The method of claim 11 further comprising forming striations on the flanks of at least some of the fully formed teeth.

15. The method of claim 11 further comprising the steps of:

producing a first surface finish on flanks of fully formed teeth located in a first angular zone about an axis; and forming a second surface finish, different from the first surface finish, on the flanks of fully formed teeth located in a second angular zone about the axis.

16. The method of claim 11 further comprising the steps of:

forming a first surface finish on the second die teeth in a first angular zone about an axis; and forming a second surface finish that is different from the first surface finish on the second die teeth in a second angular zone about the axis.

17. The method of claim 11 further comprising the step of:

after using a mandrel to extrude the fully formed teeth in the workpiece, producing an irregular surface finish on flanks of the extruded fully formed teeth.

18. The method of claim 11 further comprising the step of:

after using a mandrel to extrude the fully formed teeth in the workpiece, producing a random, irregular surface finish on the flanks of the extruded teeth by performing one of acid etching, laser surface treatment, surface alteration using abrasive high pressure water jets, and sand blasting.

* * * * *